US005528559A

United States Patent [19]

Lucas

[11] Patent Number: 5,528,559

[45] Date of Patent: Jun. 18, 1996

[54] MULTIPLE DISPLAY TIMEPIECE

[75] Inventor: Alfred R. Lucas, Coral Springs, Fla.

[73] Assignee: Motorola, Inc., Schaumburg, Ill.

[21] Appl. No.: 494,047

[22] Filed: Jun. 23, 1995

[51] Int. Cl.[6] ..... G04B 47/00

[52] U.S. Cl. ..... 368/10; 368/80; 368/223; 368/239

[58] Field of Search ..... 368/239, 241, 368/242, 79, 80, 82, 83, 84, 41, 10

[56] References Cited

U.S. PATENT DOCUMENTS

| | | | |
|---|---|---|---|
| 4,257,115 | 3/1981 | Hatuse et al. | 368/69 |
| 4,355,380 | 10/1982 | Huguenin et al. | 368/71 |
| 4,845,485 | 7/1989 | Pace | 368/10 |
| 5,297,118 | 3/1994 | Sakumoto | 368/10 |
| 5,329,501 | 7/1994 | Meister et al. | 368/10 |

*Primary Examiner*—Bernard Roskoski
*Attorney, Agent, or Firm*—R. Louis Breeden

[57] ABSTRACT

A multiple display analog timepiece provided with a digital display (17) within the face (18) or watch crystal (13) of the timepiece (10) for displaying digital data (22), wherein the digital data (22) may be viewed without obstruction by the hands of the analog timepiece (10). The analog timepiece (10) includes an analog display (11) having at least two hands above the face (18) and below the watch crystal (13) of the timepiece; a digital display (17) within the face (18) or watch crystal (13) for visually presenting digital data (22); and motors (54) for selectively moving the hands between the position indicating the time and a read data position away from the digital data (22) when the digital data (22) is displayed on the digital display (17). The timepiece (10) may also include a radio frequency receiving device for receiving messages to be displayed as digital data (22).

14 Claims, 5 Drawing Sheets

MULTIPLE DISPLAY TIMEPIECE

FIELD OF THE INVENTION

This invention relates in general to a multiple display timepiece. More particularly, this invention relates to an analog timepiece provided with a digital display within the crystal or on the face of the timepiece for displaying data.

BACKGROUND OF THE INVENTION

Continuing improvement in circuit design has lead to smaller and smaller integrated circuits used in electronic devices. This in turn affords the opportunity to combine electronic devices, such as a selective call receiver with a timepiece, to provide a very useful and highly desirable personalized electronic device.

Generally, selective call receivers, such as pagers, can display the caller identification number and the message received on an LCD (liquid crystal display) panel section, in addition to the generation of an alarm for indicating call reception.

A typical selective call receiver may be combined with an analog watch with hour, minute and second hands controlled by a pulsed stepping motor. The stepping motor is conventionally controlled by voltage pulses at regular intervals to increment the second and in turn the minute and hour hands and thereby cause the correct time to be displayed.

Combined electronic devices of this type are illustrated in U.S. Pat. No. 4,845,485 (the '485 patent) to Pace, assigned to the assignee of the present application, and U.S. Pat. No. 5,297,118 (the '118 patent) to Sakumoto, both of which are incorporated herein by reference and described briefly below.

The pager of the '485 patent is combined with an analog watch with hour, minute and second hands controlled by a stepping motor. Normally the stepping motor is activated by a voltage pulse applied at regular intervals, such as every one second. However, during channel monitoring, means are provided to inhibit any applied voltage pulses to the stepping motor to prevent desensitization of the pager receiver. At the same time, a seconds register is incremented and later utilizes the data processor to generate and apply the appropriate delayed voltage pulses to the stepping motor in a sequential but accelerated fashion so as to bring the timepiece to current time status.

The '118 patent discloses an electronic watch with pager. In one aspect, received and stored information signals are selected in response to an output signal of the external inputting means. The time signal outputted by the time measuring means and received information signals outputted by the received information storing means are selected by the display switching means. The outputs of the display switching means are inputted to the analog display means and the digital display means, respectively. In summary, the time or the caller identification number are selectively displayed on the analog display means. The time and the caller message are selectively displayed on the digital display means. In other aspects of the '118 patent, different inputs and outputs are selected and stored such that there are different types of displays of information.

A problem with conventional watch/pagers is that they display the messages on the face of the watch, beneath the hands. Therefore, the location of the hands can interfere with the reading of the display, which can result in misinterpretation of the display or prevent one from reading the display quickly at a glance. Furthermore, display size is limited, which limits the amount of information that can be displayed without scrolling.

Thus, there is a need in the art to provide a multiple display timepiece in which the message display can be read without interference from the hands of the timepiece. In addition, a multiple display timepiece is needed that provides a larger message display.

DESCRIPTION OF THE PREFERRED EMBODIMENT

Figure 1:
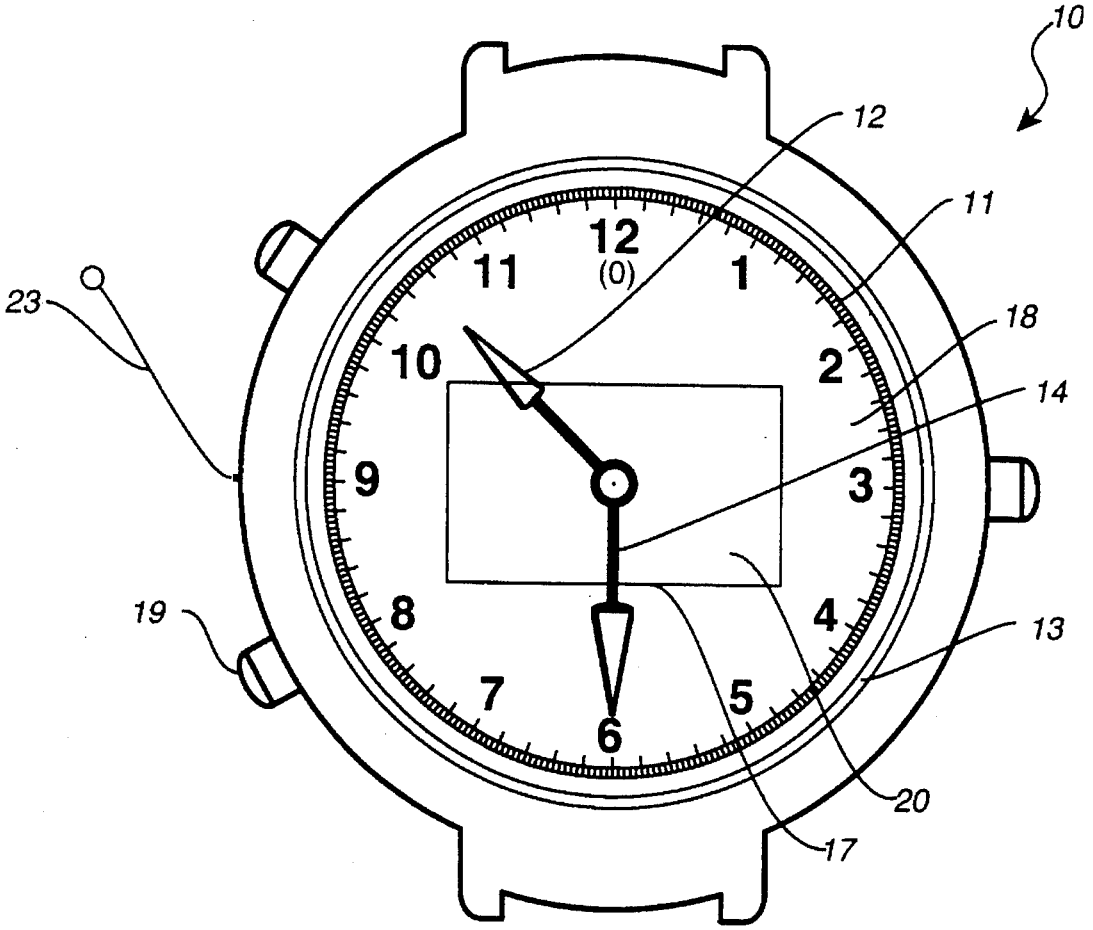
FIG. 1 is a front view of the clock mechanism of the multiple display timepiece in accordance with the preferred embodiment of the present invention.
Figure 2:
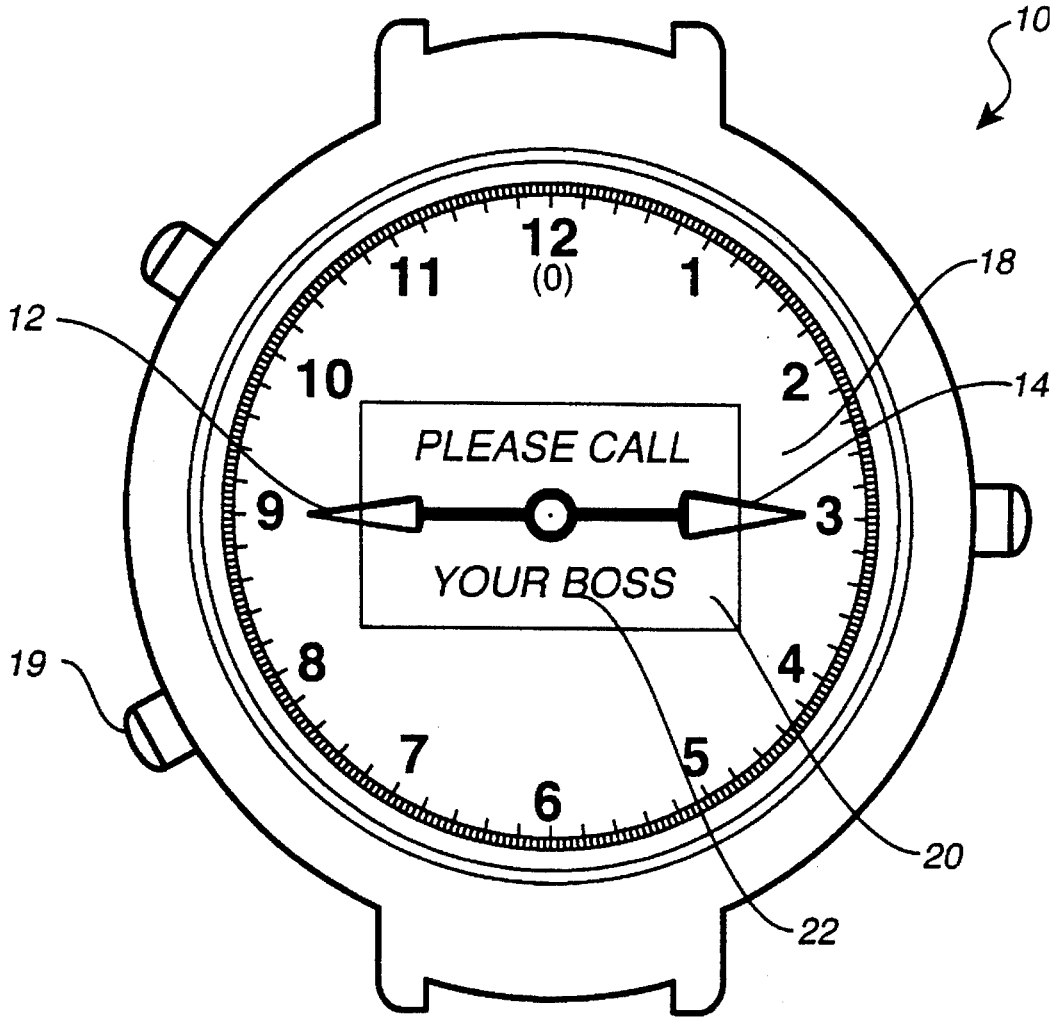
FIG. 2 is another front view of the clock mechanism of the multiple display timepiece in accordance with the preferred embodiment of the present invention with a display shown in the display area.
Figure 3:
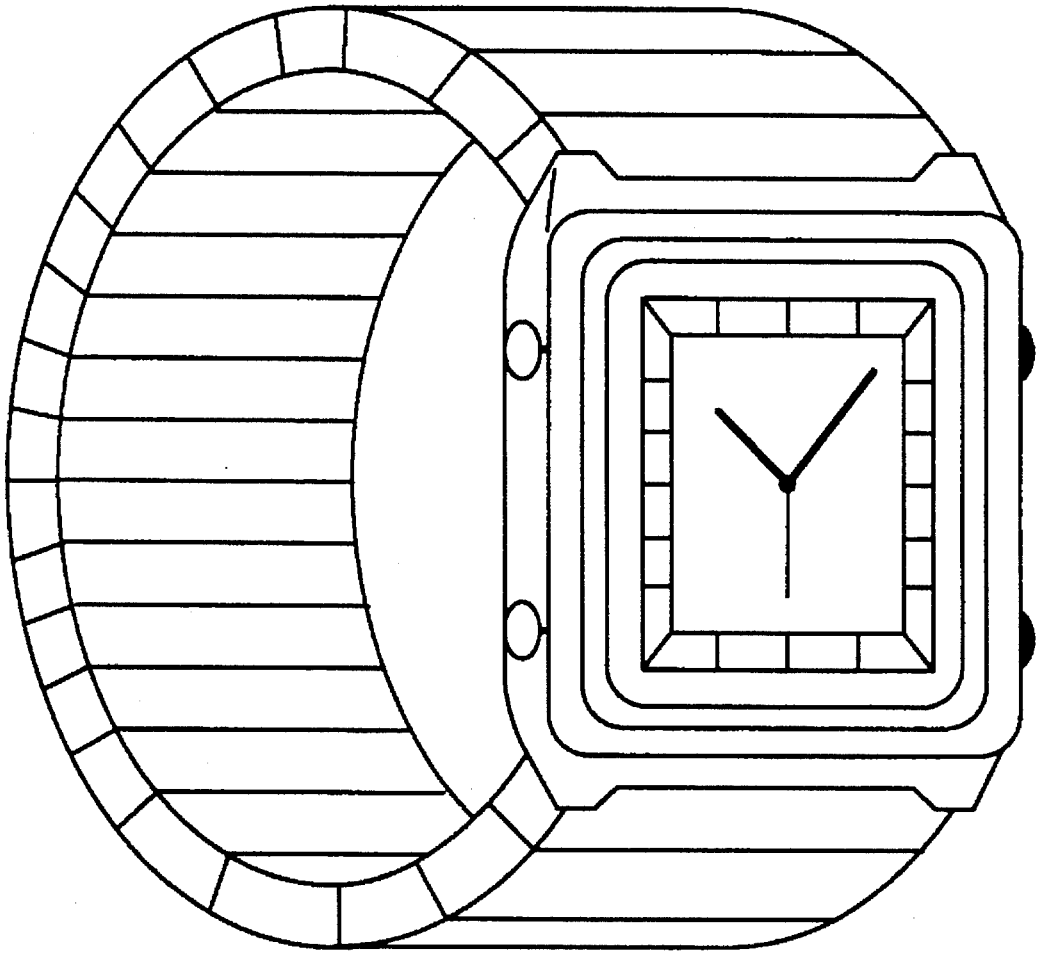
FIG. 3 is an isometric view of a conventional wristwatch which represents a preferred configuration for the multiple display timepiece in accordance with the preferred embodiment of the present invention.
Figure 4:
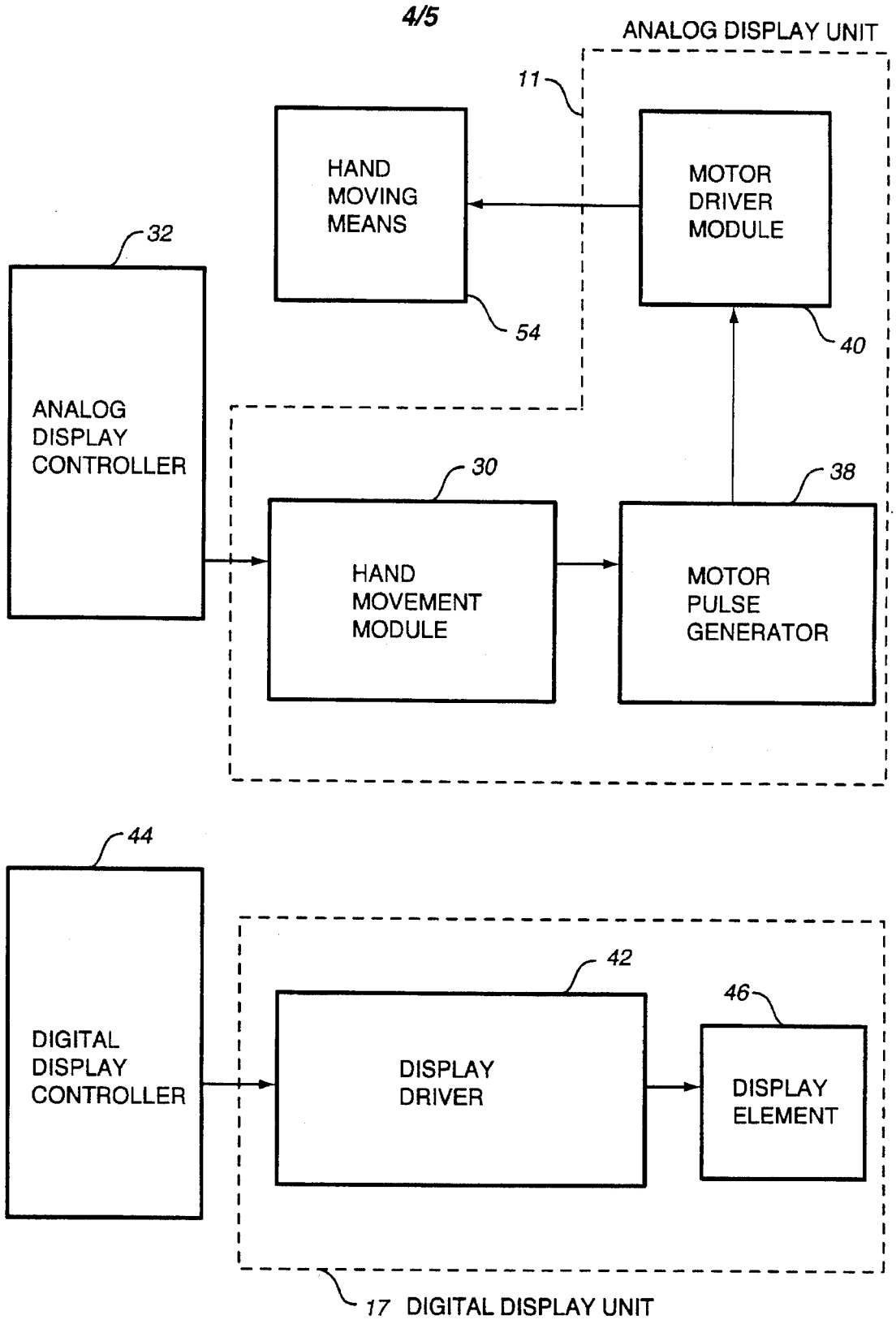
FIG. 4 is a system block diagram showing the operation of the analog timepiece of the preferred embodiment of the present invention.

Referring to FIGS. 1 and 4, in a preferred embodiment, the invention includes an analog clock mechanism or watch 10, preferably configured as a wristwatch such as that shown in FIG. 3. The watch 10 of the invention generally includes an analog display means 11, preferably having two hands, such as an hour hand 12 and a minute hand 14 above a face 18 of watch 10. Alternatively, watch 10 may also include a second hand. Hands 12, 14 indicate a relative time. Watch 10 also includes a display area 20, comprising the face 18 and a watch crystal 13 which, in combination, provide a digital display means 17 for visually presenting digital data 22 (FIG. 2). Watch 10 further includes a hand moving means 54 (see FIG. 4), preferably including a plurality of conventional motors, for selectively moving hands 12, 14 between the position indicating the relative time and a read data position away from the digital data 22 when digital data 22 is presented on digital display means 17, thereby allowing a user to view digital data 22. Moving means 54 preferably operate simultaneously, thereby moving hands 12, 14 automatically or manually away from display area 20 quickly. A user control 19 allows a user to effect presentation of the digital data 22 on the display means 17.

Referring to FIG. 2, the preferred embodiment in accordance with the present invention is shown with digital data 22, such as a message, displayed in display area 20. Hands 12, 14 have been moved away from the digital data 22 so that digital data 22 can be accurately and quickly read. Digital display means 17 is preferably an LCD embedded in watch crystal 13, thereby providing a larger display and greater ease in quickly reading the digital data 22. Such a display is available from Seiko Instruments, Inc. of Chiba, Japan. Alternatively, digital display means 17 can be embedded in face 18. In the preferred embodiment, digital data 22 is one of an unlimited number of customized messages, such as those received and displayed by conventional personal messaging units, selective call receivers or paging devices.

Referring to FIG. 4, analog display means 11 is controlled by a conventional analog controller 32 which determines the correct hand position based on the relative time or, when active, based on a predetermined "read data" positioning of hands 12, 14. Specifically, moving means 54 for selectively moving hands 12, 14 is controlled by analog display controller 32 responsive to an input signal, the controller 32 directing moving means 54 to position hands 12, 14 responsive to the input signal. Preferably, for simplicity, a single read data position is utilized. It will be appreciated that, alternatively, a plurality of read data positions can be utilized, e.g., to reduce positioning time.

In operation, the input signal signal's controller 32 to direct moving means 54 to position hands 12, 14 to indicate the relative time. The input signal also signals controller 32 to direct moving means 54 to selectively move hands 12, 14 to the read data position. Analog display means 11 preferably includes a conventional hand movement module 30 and a conventional motor pulse generator 38 for generating the signal which controls a conventional motor driver module 40 and moving means 54 for driving hands 12, 14 on the basis of this signal.

Figure 5:
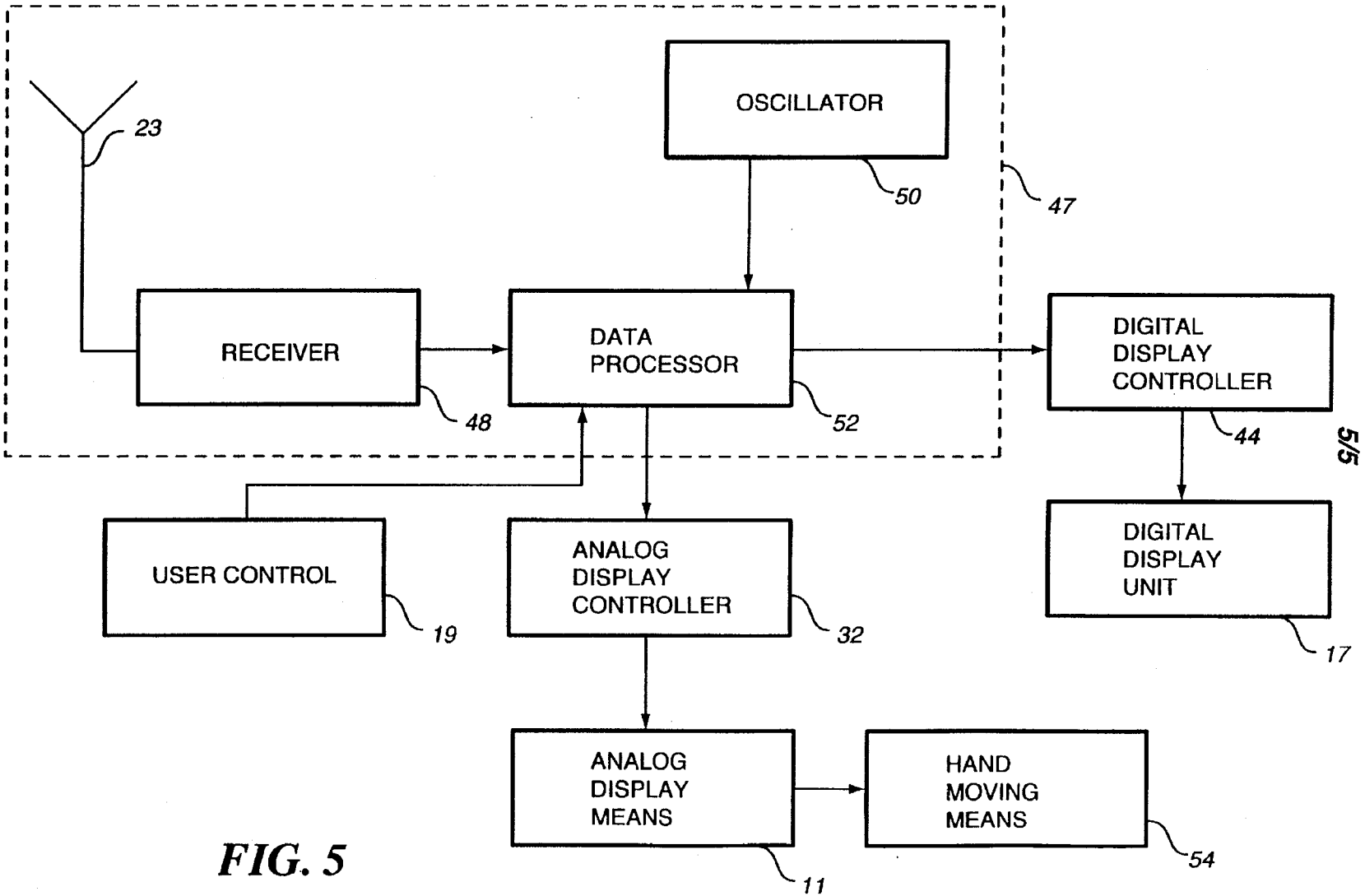
FIG. 5 is a system block diagram showing the operation of the receiving circuitry of the preferred embodiment of the present invention.

Referring to FIGS. 4 and 5, the input signal may be manually controlled by the user through the user control 19. Alternatively, the input signal may be controlled by a conventional data processor 52 within watch 10, in response to a received message. Processor 52 supplies the input signal which automatically signals analog display controller 32 to direct moving means 54 to selectively move hands 12, 14 to the read data position when hands 12, 14 obstruct digital data 22 on digital display means 17. Processor 52 also supplies the input signal which signals analog display controller 32 to direct moving means 54 to move hands 12, 14 back to indicate the relative time after a predetermined time delay, such as one minute after hands 12, 14 are moved to the read data position.

Digital display means 17 is controlled by a conventional digital controller 44 which determines the messages to be displayed. Digital display means 17 is composed of a conventional display driver 42 and a conventional display element 46, such as a seven segment digital LCD, for displaying a message in a digital manner on the basis of the output of display driver 42. The user is alerted by conventional alert means, such as an audible tone or vibration, when a message is received and displayed.

Referring to FIG. 5, preferably watch 10 also includes a radio frequency receiving device circuitry 47 within watch 10 for receiving messages and providing the display of digital data 22. The circuitry 47 in accordance with the preferred embodiment of the current invention preferably includes a receiver 48. Receiver 48 preferably is similar to receivers used in conventional personal messaging units and selective call receivers. The radio frequency receiving device circuitry 47 can provide an unlimited number of customized messages as digital data 22 on digital display means 17.

A conventional oscillator 50 is provided in combination with data processor 52. Digital display means 17 receives signals from data processor 52. Referring to FIGS. 1 and 5, an external antenna 23 is further included to intercept communication, signals which can include a unique selective call address as well as any associated messages intended for the watch 10. Communication signals preferably are in the form of binary digits (bits) modulated on a carrier frequency.

Watch 10 preferably has a POCSAG decoder, although it may incorporate other paging protocols well known to one of ordinary skill in the art. Processor 52 preferably has internal ROM, and is programmed for controlling watch 10 in accordance with the present invention.

As well understood by one of ordinary skill in the art, receiver 48 of the combined pager/watch device responds to signals transmitted and received by antenna 23. Receiver 48 receives, demodulates, and passes the bits to data processor 52. Data processor 52, in a well known manner, processes the detected binary information to determine if the pagers' address is present, and if so, to further process any associated message intended therefor. The timing (clock) signals to permit such data processing are provided by oscillator 50.

Data processor 52 preferably also provides a "battery saver" strobe signal to receiver 48 on a periodic basis whereby receiver 48, normally powered-down, comes up to full operating level and monitors the airwaves and determines if there is a signal being transmitted which is of interest to the pager portion of the device. At all other times, receiver 48 is in a deactivated state.

Oscillator 50 preferably also serves to provide the timing signals for data processor 52 in generating and applying the necessary periodic voltage pulses to motors 54 so as to move watch second hand 16 at regular (i.e., one second) intervals. In this manner, analog display means 11 displays current time.

In operation, watch 10, when operating only in the time display mode, displays the time according to the time to which it was set, which is referred to as the relative time. When a call is placed or a message is otherwise sent to the user of watch 10, hands 12, 14 preferably are manually (such as by operating user control 19) moved away from digital data 22, into a "read data" position, such that the hands show approximately 2:45, or 9:15. It will be appreciated that alternative positions for display area 20 can require alternative read data positions, e.g., approximately 6:30 or 12:00. Preferably, after a predetermined amount of time, hands 12, 14 are moved back to the position according to the relative time. Alternatively, operation of the user control 19 can restore the relative time position.

Alternatively, watch 10, in addition to or instead of being combined with a receiving device, may be combined with a variety of other electronic devices needing a display area. Such other devices can include, for example, a video display device and a video game (not shown). Digital data 22 can then be represented in video format.

While specific embodiments have been shown and described, many variations are possible. Watch 10 preferably includes only hour and minute hands (to limit the number of motors required for hand movement). Alternatively, watch 10 may also include a second hand. The invention can be used on a combination watch, i.e. a watch with analog and digital display functions. Various types of pagers, video displays and video games, as well as calculators and other devices can be combined with the timepiece of the invention. The timepiece can be a pocket watch or other type of timepiece not worn on the wrist.

Having described the invention in detail, one of ordinary skill in the art will appreciate that modifications may be made of the invention without departing from its spirit. Therefore, it is not intended that the scope of the invention be limited to the specific embodiments illustrated and described. Rather, it is intended that the scope of the invention be determined by the appended claims and their equivalents.

What is claimed is:

1. A multiple display timepiece, comprising:

an analog display means having at least two hands positioned on a top surface of a face of said timepiece at a position indicating information consisting of a relative time;

a digital display means disposed within a display area of said timepiece for visually presenting digital data comprising a plurality of customized messages, wherein the digital display means and the analog display means overlap with one another such that said hands interfere with viewing said digital data depending upon said position of said hands; and means coupled to the analog display means for selectively moving said hands between said position indicating said relative time and a read data position that minimizes interference with viewing said digital data when said digital data is displayed on said digital display means.

2. The timepiece of claim 1, wherein said digital display means is disposed below said hands within said face within said display area of said timepiece.

3. The timepiece of claim 1, wherein said digital display means is disposed above said hands within a watch crystal within said display area of said timepiece.

4. The timepiece of claim 1, wherein Said means for selectively moving said hands is controlled by an analog display controller which, responsive to an input signal, directs said hand moving means to position said hands.

5. The timepiece of claim 4, wherein said input signal is controlled by a user.

6. The timepiece of claim 4, wherein said input signal is controlled by a processor within said timepiece.

7. The timepiece of claim 6, wherein said processor supplies said input signal, which directs said hand moving means to selectively move said hands when said digital data is displayed on said digital display means.

8. The timepiece of claim 7, wherein said processor supplies said input signal, which signals said controller to direct said hand moving means to move said hands to indicate said relative time after a predetermined time delay after said hands are moved when said digital data is displayed on said digital display means.

9. The timepiece of claim 4, wherein said hand moving means comprises a plurality of motors.

10. The timepiece of claim 5, wherein said digital display means is a liquid crystal display.

11. The timepiece of claim 5, further comprising a radio frequency receiving device.

12. The timepiece of claim 11, wherein said radio frequency receiving device provides said digital data.

13. The timepiece of claim 12, wherein said radio frequency receiving device provides the plurality of customized messages displayed on said digital display means.

14. A multiple display timepiece provided with a selective call receiver, comprising:

an analog display means having at least two hands positioned on a top surface of a face of said timepiece at a position indicating information consisting of a relative time;

a digital display means disposed within a display area of said timepiece for visually presenting digital data received by said selective call receiver and comprising a plurality of customized messages, wherein the digital display means and the analog display means overlap with one another such that said hands interfere with viewing said digital data depending upon said position of said hands; and hand moving means coupled to said analog display means for moving said hands between said position indicating said relative time and a read data position that minimizes interference with viewing said digital data, an analog display controller coupled to said hand moving means for controlling said hand moving means responsive to an input signal, said analog display controller directing said hand moving means to position said hands responsive to said input signal; and a processor coupled to said analog display controller for controlling said input signal, said processor supplying said input signal which automatically signals said analog display controller to direct said hand moving means to selectively move said hands to the read data position when said digital data is displayed on said digital display means, wherein said processor subsequently controls said input signal after a predetermined time delay to signal said analog display controller to direct said hand moving means to move said hands to indicate said relative time.

* * * * *